United States Patent [19]

Gaisch et al.

[11] Patent Number: 4,622,982

[45] Date of Patent: Nov. 18, 1986

[54] CONTINUOUS METHOD OF DENITRATING TOBACCO EXTRACTS

[75] Inventors: Helmut Gaisch; Beth Krasna, both of Cormondrèche; Dieter Schulthess, Neuchâtel, all of Switzerland

[73] Assignee: Fabriques de Tabac Reunies S.A., Neuchâtel, Switzerland

[21] Appl. No.: 156,910

[22] Filed: Jun. 6, 1980

[30] Foreign Application Priority Data

Aug. 20, 1979 [LU] Luxembourg ..... 81611
Feb. 25, 1980 [LU] Luxembourg ..... 82199

[51] Int. Cl.[4] ..... A24B 3/14; A24B 15/02

[52] U.S. Cl. ..... 131/297; 131/308; 131/356; 131/370; 435/267; 210/603; 210/605; 210/903; 210/622

[58] Field of Search ..... 131/143, 140–142, 131/144, 308, 297, 356; 210/601, 603, 605; 435/172, 262, 267

[56] References Cited

U.S. PATENT DOCUMENTS

| | | | |
|---|---|---|---|
| 2,000,855 | 5/1935 | Lippman et al. | 131/6 |
| 2,149,179 | 2/1939 | Moser | 131/6 |
| 2,644,462 | 7/1953 | Frankenburg | 131/141 |
| 3,709,364 | 1/1973 | Savage | 210/195 |
| 3,747,608 | 7/1973 | Gravely et al. | 131/141 |
| 3,829,377 | 8/1974 | Hashimoto | 210/11 |
| 3,845,774 | 11/1974 | Tso et al. | 131/140 |
| 3,966,554 | 6/1976 | Vass et al. | 195/30 |
| 4,011,141 | 3/1977 | Gravely et al. | 195/96 |
| 4,037,609 | 7/1977 | Newton et al. | 131/144 |
| 4,038,993 | 8/1977 | Geiss et al. | 131/141 |
| 4,039,438 | 8/1977 | Anderson | 210/11 |
| 4,043,936 | 8/1977 | Francis et al. | 252/301.1 |
| 4,135,521 | 7/1979 | Malan et al. | 131/141 |
| 4,140,136 | 2/1979 | Geiss et al. | 131/17 R |

FOREIGN PATENT DOCUMENTS

| | | | |
|---|---|---|---|
| 866445 | 8/1978 | Belgium . | |
| 874050 | 5/1979 | Belgium | 131/308 |
| 909063 | 9/1972 | Canada . | |
| 7930070 | 10/1979 | European Pat. Off. . | |
| 2816427 | 11/1978 | Fed. Rep. of Germany . | |
| 2820414 | 9/1979 | Fed. Rep. of Germany . | |
| 2922283 | 12/1979 | Fed. Rep. of Germany . | |
| 2922284 | 1/1980 | Fed. Rep. of Germany . | |
| 2014031 | 8/1979 | United Kingdom | 131/308 |

OTHER PUBLICATIONS

Francis; "High Nitrate Denitrification in Continuous Flow-Stirred Reactors", *Water Research,* vol. 11, pp. 289–294, 1977.

Rainbow et al.; *Biochemistry of Industrial Micro-Organisms;* Academic Press; 1963, pp. 39 and 100.

Bailey; *Biochemical Engineering Fundamentals;* McGraw-Hill; 1977, p. 581.

*Primary Examiner*—V. Millin
*Assistant Examiner*—Gregory Beaucage
*Attorney, Agent, or Firm*—Arthur I. Palmer, Jr.; James F. Haley, Jr.; Margaret A. Pierri

[57] ABSTRACT

An improved method of reducing the nitrate, nitrite and ammonium compound content of an aqueous tobacco extract employing microorganisms is described. The nitrates, nitrites and ammonium compounds are eliminated on a continuous basis via an aerobic assimilatory metabolic pathway by introducing aqueous tobacco extract and necessary additives into a work mixture, containing suitable microorganisms, at a dilution rate which does not exceed the growth rate of the microorganisms while withdrawing a portion of the work mixture at a rate such that the volume of the work mixture remains constant. Optionally the biomass may be removed from the withdrawn mixture.

45 Claims, 1 Drawing Figure

CONTINUOUS METHOD OF DENITRATING TOBACCO EXTRACTS

BACKGROUND OF THE INVENTION

1. Technical Field

This invention relates to a continuous process for reducing the levels of certain nitrogen-containing compounds present in tobacco materials using microorganisms. Specifically, the present invention provides a process for reducing the levels of nitrates, nitrites and ammonium compounds via an aerobic assimilatory metabolic pathway employing conditions such that continuous, rather thar batch, operation is possible.

2. Description of Prior Art

It is generally recognized that smoking products having lowered amounts of oxides of nitrogen present in smoke are desirable. Therefore, a number of methods have been developed to reduce the delivery of oxides of nitrogen by smoking products. Among these techniques are various methods wherein the nitrate content of the tobacco is altered. For example, methods involving microbial treatment of tobacco to accomplish such nitrate reduction have been proposed.

Specifically in Gaisch et al. Belgian Pat. No. 886,445 published Aug. 14, 1978 and assigned to Fabriques de Tabac Reunies S.A. a process for degrading nitrates and nitrites in tobacco to nitrogen or ammonia compounds by means of microorganisms which would normally require oxygen, but are capable of anaerobic denitration is described. Gaisch et al. German Offenlegungsschrift No. 28 16427, filed Apr. 15, 1978 and published Nov. 9, 1978, describes a process for microbial degradation of nitrate, nitrite and other nitrogen containing compounds in tobacco. According to Gaisch et al., under nitrogen deficiency or oxygen deficiency conditions, the microorganisms employed obtain their nitrogen or oxygen requirements respectively from nitrate or nitrite degradation. The microorganisms which can be used in these two processes may be selected from the genus Aerobacter, Pseudomonas, Micrococcus or Escherichia, with *Enterobacter aerogenes* being specifically employed in the examples.

European Patent Application No. 79 300 706.3 published Oct. 31, 1979, describes a process for microbial reduction of nitrates in tobacco via a dissimilatory denitrification pathway whereby nitrogen gas is the end product. The microorganism specifically suggested for use in the process is *Paracoccus denitrificans* or *Micrococcus denitrificans*. Species of the genera Pseudomonas, Alcaligenes, Bacillus and Propionibacterium can also be employed.

Further U.S. Pat. No. 3,845,774 to Tso et al. describes tobacco treatment methods referred to as homogenized leaf curing wherein the tobacco is homogenized and incubated during curing in order to regulate the composition of the final product. Nitrate-nitrogen and total nitrogen are reduced somewhat; however, the amount of reduction is not as significant as that of the present process. Although Tso et al. allude to the fact that tobacco modification can be accomplished by the use of additional techniques during homogenization and incubation, such as enzyme and microbial action, no specific methods or means for reducing nitrate-nitrogen are suggested.

Gravely et al., U.S. Pat. No. 3,747,608 relates to a method for aerobic microbial digestion of pectin-bound plant material, specifically tobacco materials. Although the invention deals predominantly with methods for fibrillation tobacco materials using pectolytic enzyme-producing microorganisms, Examples 11 and 13 disclose data related to the concomitant denitration of tobacco using the mioroorganism *Erwinia carotovora*, ATCC 495. This microorganism is unsuitable for use in the present invention since pectolytic enzyme-producing microorganisms, such as *Erwinia carotovora*, destroy the structural integrity of the tobacco.

W. O. Atkinson et al. reported a reduction in various tobacco leaf components, including nitrate-nitrogen, by varying homogenization and incubation techniques during curing. (Abstract of Proceedings of the University of Kentucky Tobacco and Health Research Institute, Lexington, Ky., Conference Report 4, March 1973, pages 829–33.)

Denitration by means of microorganisms is also known outside the tobacco arts. Representative examples are U.S. Pat. No. 3,709,364 to Savage, U.S. Pat. No. 3,829,377 to Hashimoto, U.S. Pat. No. 4,039,438 to Anderson, and U.S. Pat. No. 4,043,936 to Francis et al. which describe denitrification of waste water using anaerobic bacteria to reduce the nitrate to nitrogen gas. Members of the Thiobacillus, Pseudomonas, Chromobacter, Bacillus and Clostridium genera are among the microorganisms which may be employed. In the Hashimoto patent the use of pressurized systems to increase the amount of methane available to the microorganisms and to facilitate liberation of the nitrogen gas by venting are suggested. The Anderson patent suggests conducting the process at ambient or atmospheric pressure. In the Francis patent the nitrogen gas passes through an exit out of the system. The Savage reference employs pressure to pass the effluent being treated through the filter containing the microorganisms.

Microorganisms have also been used to modify other tobacco components. For example, U.S. Pat. Nos. 4,037,609 and 4,038,993 to Geiss et al. disclose methods for reducing the nicotine content of tobacco by microbial treatment using microorganisms obtained from tobacco, including *Pseudomonas putida* and Cellulomonas sp. Aerobic fermentation techniques are employed wherein nicotine is degraded via microbial action to 3-succinoylpyridine. The latter microorganism is capable of reducing nitrate to nitrite and actively produces nitrogen gas. Similarly degradation of nicotine to 3-succinoylpyridine by means of the same microorganisms is described in U.S. Pat. No. 4,011,141 to Gravely et al. Lippmnan et al. U.S. Pat. No. 2,000,855 describes microbial denicotinization of tobacco by fermenting moist tobacco while adding acid to overcome the alkaline condition produced by fermentation. Alternatively the patent suggests removal of volatile bases by supplying an air current or employing suction. Fermentation was used to improve aroma and mellowness in U.S. Pat. No. 2,644,462 to Frankenburg and in U.S. Pat. No. 4,135,521 to Malan et al.

Further, U.S. Pat. No. 2,149,179 relates to an accelerated aging method for tobacco wherein the aging is effected by means of fermentation with exclusion of oxygen employing microorganisms capable of growing in the absence of oxygen. The microorganisms may be those which are bred on noble tobaccos or anaerobic yeasts. By means of the process, fermentation times of only days, rather than months are required. The purpose of the claimed fermentation process is to improve the bouquet of the tobacco. Nicotine content in the tobacco is also reduced. According to the patent, a prior process of Suchsland, which used microorganisms to decompose complex organic substances in tobacco into simpler compounds, did not prove practical since the oxidation effected by oxygen during the fermentation was ignored.

We have now unexpectedly discovered that by employing carefully controlled conditions, it is possible to effect denitration via an aerobic assimilatory metabolic pathway on a continuous basis. Specifically it has been discovered that by controlling the denitration conditions, it is possible to coordinate the microorganisms' growth rate with the tobacco extract treatment rate, whereby a denitration process is provided which is easily adapted to other continuous tobacco treatment processes, can be employed on a continuous basis for extended periods with relatively little or no supervision and permits treatment of greater amounts of tobacco extract and results in a higher production rate relative to batch processes. That is, the present process provides a method whereby nitrates, nitrites and ammonium compounds can be efficiently eliminated from tobacco via an assimilatory metabolic process on a large, technical scale under economical conditions, with a minimal requirement of manpower or energy and minimal addition to or transformations of the tobacco extract components, other than such denitration.

SUMMARY OF THE INVENTION

Figure 1:
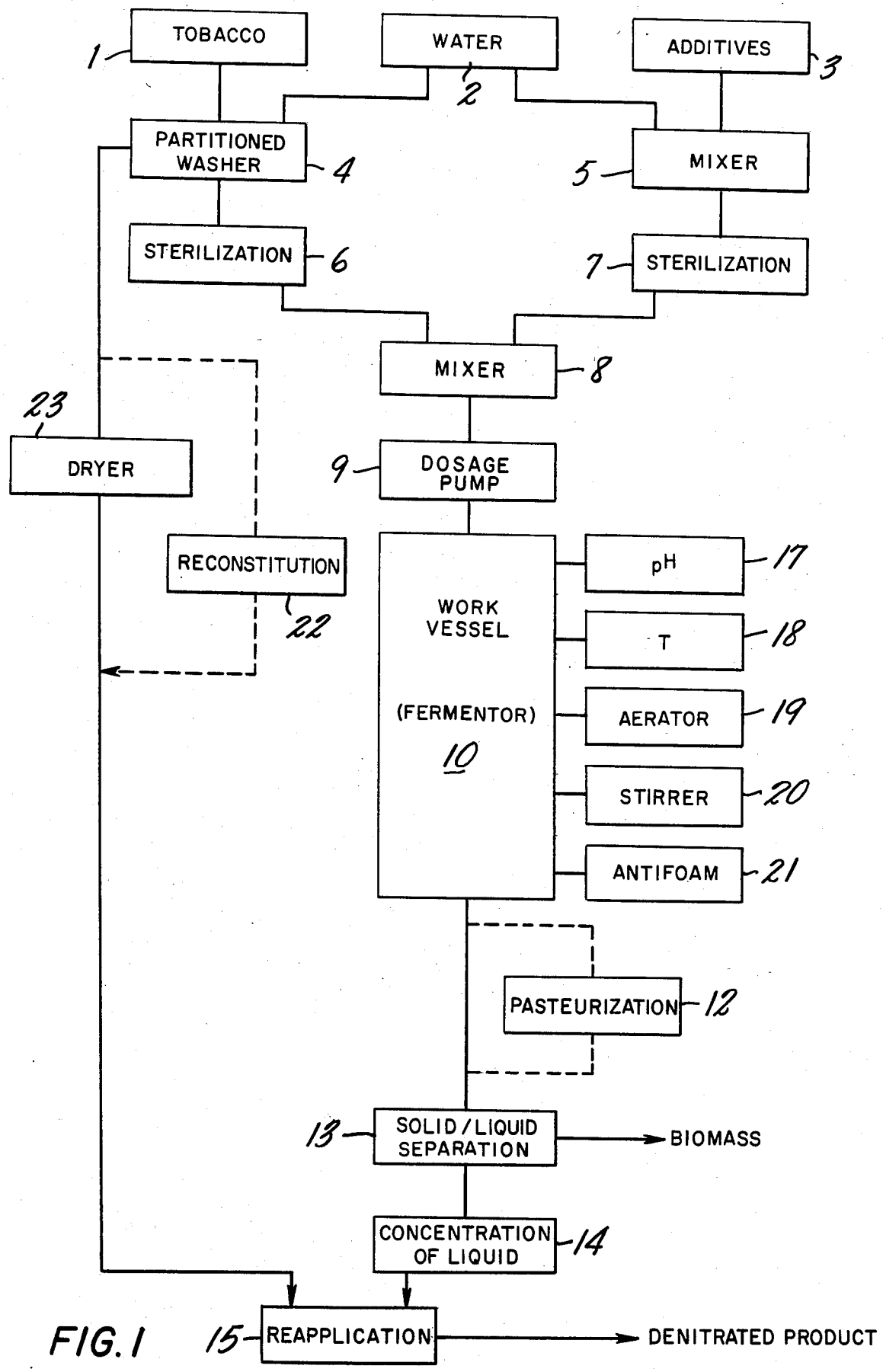
FIG. 1 is a flow diagram of a tobacco denitration system from the extraction of tobacco through the denitration steps of the present invention up to the reapplication of the denitrated extract to the extracted tobacco.

A continuous method for denitrating an aqueous tobacco extract which comprises contacting said extract with a work mixture containing tobacco extract and microorganisms, which are capable of metabolic, aerobic assimilation of nitrogen-containing compounds and which are in exponential growth phase, while maintaining pH, temperature and aeration at levels which promote aerobic assimilation, by adding the extract to the work mixture at a dilution rate which does not exceed the growth rate of the microorganisms while additionally adding phosphate and a carbon source to the work mixture, said extract, phosphate and carbon source being sterile when added and being added in amounts such that the overall addition thereof is 0.1–7.5 g nitrate/l added, 1.0 to 10 g $PO_4^{3-}$/l added and sufficient carbon source to provide at least 16.5 assimilative carbon atoms /$NO_3$ molecule added, while withdrawing a portion of the work mixture at a rate such that the volume of work mixture remains constant and thereafter removing the microorganisms from the withdrawn mixture. Preferred microorganisms for use in the present process are Candida yeasts. Denitration with such yeasts may be effected continuously as described above employing a dilution and withdrawal rate of 0.1 to 0.35 liter of additives and extract per liter of work mixture per hour while maintaining a pH of 3.5 to 7.2, a temperature of 25° to 37° C. and an aeration rate of 0.8 to 2.5 liters air per liter work mixture per minute. Enterobacter aerogenes may also be used in the present process. Denitration with such microorganisms may be effected on a continuous basis employing a dilution and withdrawal rate of 0.1 to 0.25 liter of additives and extract per liter of work mixture per hour while maintaining a pH of 5.5–8, a temperature of 30°–40° C. and an aeration rate of 1.0 to 3 liters air per liter work mixture per minute.

DETAILED DESCRIPTION OF THE INVENTION

The present invention provides a method whereby denitration of tobacco extracts may be effected in a continuous manner employing microorganisms capable of aerobic assimilation of nitrate, sometimes referred to as nitrate ammonification. It is possible to run a system employing the denitration method of the invention for extended periods with little or no supervision.

Continuous assimilatory denitration is effected according to the present invention by introducing material to be treated into a fermentation vessel while withdrawing treated extract from the fermentor at the same rate, such that the overall volume of material in the fermentor, that is, the work mixture, remains constant. Moreover, the rate of extract introduction and withdrawal and the process conditions are such that there is no need to repeatedly inoculate the work mixture; rather after a single inoculation a system employing the present denitration process can be run for extended periods without reinoculation.

Broadly stated the present denitration process comprises introducing aqueous tobacco extract along with necessary additives into a vessel in which is a mixture containing suitable microorganisms while simultaneously withdrawing treated extract from the vessel. By controlling the flow rate of extract into and out of the system, the components within the system and the conditions within the vessel, it is possible to denitrate the extract without depletion of the microorganisms and thus to effect treatment on a continuous basis.

The metabolic pathway employed in assimilatory denitration can be represented as follows:

$$8(H)+H^{+}+NO_3^{-}\rightarrow NH_4^{+}+OH^{-}+2H_2O$$

Such assimilatory denitration thus involves the use of nitrate as a nitrogen source to build up cell material.

In the practice of the present invention, microorganisms capable of assimilatory denitration must be employed. Various yeasts, particularly Candida yeasts, are capable of nitrate assimilation. Among the Candida yeasts, the *Candida utilis* NCYC 707, 321 and 359 strains, the *Candida utilis* DSM 70167 strain, which is the same as the NCYC 359 strain, and the *Candida berthetii* CBS 5452 strain have been found particularly effective in the practice of the present invention. Microorganisms, such as *Enterobacter aerogenes,* particularly *Enterobacter aerogenes* ATCC 13048, which is the same as the DSM 30053 strain, may also be employed in the practice of the present invention.

These cultures are available at the culture banks indicated by the abbreviations. The meaning of the abbreviations is as follows:

NCYC: National Collection of Yeast Cultures Brewing Industry Research Foundation CBS: Central Bureau of Mold Cultures ATCC: American Type Culture Collection DSM: German Collection of Microorganisms Table I, II, III are descriptions of the cultures.

The Candida yeasts and *Enterobacter aerogenes* ATCC 13048 are characterized in Tables I–III.

Table I

Characterization of Candida Yeasts

Plasmodium or pseudoplasmodium-; motile cells-; ballistospores-; monopolar budding-; bipolar budding-; budding on stolons-; triangular-shaped cells-; teniform* cells-; short lived cells with slow growth on malt agar and strong acetic acid production-; formation of true mycelium-; formation of pseudomycelia+; red or orange-colored cultures-.

TABLE II

Characterization of *Candida utilis* and *Candida berthetii*

| Fermentation | *Candida utilis* NCYC 707 NCYC 359 CBS 321 | *Candida berthetii* CBS 5452 |
|---|---|---|
| Glucose | + | + |
| Galactose | − | − |
| Sucrose | + | − |
| Maltose | − | − |
| Cellobiose | − | − |
| Trehalose | − | − |
| Lactose | − | − |
| Melibiose − | − | |
| Raffinose | + | − |
| Melicitose | − | − |
| Inulin | − | − |

Assimilation:

glucose+/+; galactose−/−; L-sorbose−/−; sucrose+/−; Maltose+/−; cellobiose+/+; trehalose+*/−; Lactose−/−; Meliboise−/−; raffinose+/−; Melicitose+/−; inulin+/−; soluble starch−/−; D-xylose+*/−; L-arabinose−/−; D-arabinose−/−; D-ribose−/−; L-rhamnose−/−; ethanol+*/−; glycerine+/+; erythrol−/−; tibitol−/−; galactitol−/−; D-mannitol+−*/−; D-glucitol−/−; α-methyl-D-glucoside+*/−; salicin+/+; DL-lactate+/−; succinate +*/+*; citrate+/+*; inositol−/−.
Assimilation of potassium nitrate+/+; growth in vitamin free medium+*/+; growth promoting vitamins thiamine; NaCl-tolerance % (W/V) 6-8/6-7; maximum growth temperature in °C. 39-43/40-41.

+ = good
* = weak
− = not present

Table III

Characterization of *Enterobacter aerogenes* ATCC 13048

Cellform short rods; cilia peritrichous; motility+; spore formation-; pigmentation-; gram reaction-; aerobic+; anaerobic+; catalase+; oxidase-; nitrite formation from nitrate+; indole-; methyl red-; Voges Proskauer+; citrate+; $H_2S$-; urease-; gelatin-; lysine decarboxylase+; argininedehydrolase-; hydrolase-; ornithinedecarboxylase+; phenylalaninedesaminase-; malonate+; gas from glucose+; lactose+; saccharose+; mannitol+; dulcitol-; salicin+; adonitol+; inositol+; sorbitol+; arabinose+; raffinose+; rhamnose+.

The process of the invention is practiced by providing a work mixture comprising tobacco extract, additives, and microorganisms at conditions suitable for assimilation of nitrogen-containing compounds, specifically, nitrites, nitrates, and ammonium compounds. For purposes of the present invention, references to nitrogen-containing compounds are to be understood to mean nitrogen-containing compounds which are aerobically assimilated by microorganisms. Denitration in turn is to be understood as referring to removal of such nitrogen-containing compounds.

The work mixture comprises suitable microorganisms in tobacco extract under conditions which promote aerobic assimilation of nitrogen-containing compounds. Generally, to start assimilation 30–100 g of starter culture mass of microorganisms are inoculated per liter of tobacco extract under conditions favorable to aerobic assimilation.

For optimum results and to avoid lag phase, a starter culture which is in exponential growth phase, and preferably late exponential growth phase, and whioh has been pregrown on tobacco extract is employed. Such a starter culture of Candida yeast can be prepared for example by inoculating tobacco extract with 2 loops of yeast, incubating the inoculated yeast for 9 hours, employing 10 ml of the resultant solution as an inoculum for 200 ml of fresh extract substrate and thereafter incubating for 15 hours. Typically the amount of such a starter culture used to inoculate the work mixture is sufficient to produce a final concentration of culture in mixture of at least 0.5–1%.

Conditions which promote effective aerobic assimilation are maintained in the work mixture during the practice of the process. Generally suitable conditions for Candida yeasts are an aeration rate of 0.8 to 2.5 liters air/liters work mixture/minute, a pH value within the range of 3.5 to 7.2 and a temperature at a point between 25° and 37° C. which is favorable for a large proportion of nitrate elimination relative to carbon added plus adequate agitation.

In the continuous operation of the process, a sterile additive mixture made up of tobacco extract and additives is added to the work mixture at a dilution rate which does not exceed the growth rate of the microorganisms employed. This dilution rate is measured as liters of additive solution per liters work mixture per hour. Generally, dilution rates of 0.1 to 0.35 l/l/hr are acceptable. Sterilization of the additive mixture can be accomplished by heating.

The additive mixture may be added as a single solution containing the tobacco extract and additives or the individual materials may be separately introduced into the work mixture. Overall the total additions to the work mixture comprise 0.1 to 7.5 grams nitrate/liter of total additive mixture depending on the microorganism employed and 1.0 to 10 grams phosphate/liter of total additive mixture, as well as a carbon source at a concentration sufficient to provide at least 16.5 assimilative carbon atoms per molecule of nitrate added.

During the practice of the process, a portion of the work mixture is continuously removed at a rate such as to keep the volume of the work mixture constant. The withdrawn work mixture may be further treated to remove the biomass therefrom, that is, the microorganisms are removed, whereby denitrated extract is obtained which is of substantially the same composition as the original extract except for the removal of the nitrate.

It is preferable to allow the starter culture to reach the exponential growth phase in the work mixture prior to commencing continuous operation of the process. However, aside from the one-time starting phase, whose products can be discarded, the process can be operated on a continuous basis with maintenance and regulation of conditions for the effect desired with little or no supervision. In contrast, various treatment phases are required in a noncontinuing, charged, so called batch process and if mistakes are made with a batch process, new conditions for assimilation have to be achieved, which could take hours. Production by batch techniques is, thus, costlier and requires more personnel than with the process described in the invention.

The aqueous tobacco extract employed in the process of the invention may be obtained in a conventional manner. One method comprises contacting tobacco with water in a 1:10 ratio, commonly at elevated temperature. The insoluble tobacco residue is thereupon separated from the aqueous extract by suitable solid/liquid separation techniques, such as centrifugation, pressing or the like. The insoluble residue may then be dried or subjected to reconstitution. If necessary, the concentration of nitrate is adjusted for addition to the work mixture by evaporation or dilution of the tobacco extract.

In contrast to batch methods, wherein the phosphate present in stem pool extracts is sufficient, phosphate must be added in the practice of the present process. Thus the additive mixture must contain phosphates, as well as a carbon source, in amounts sufficient for cell growth and total nitrate absorption. Typically 1.0 to 10 grams of phosphate/liter of additive mixture and enough carbon source to provide at least 16.5 assimilative carbon atoms/molecule of nitrate added are adequate for additive mixtures containing 3–7.5 grams nitrate. Preferably the concentrations of carbon source and phosphate are such that they are consumed during assimilation of the nitrate and thus do not reach the final denitrated extract. However, higher concentrations of these materials can be tolerated in the practice of the present invention.

The carbon source may be any material that will provide the necessary carbons in an organic form usable by the microorganism to assimilate nitrates, nitrites and the like. Various carbon sources have been found suitable in the practice of the invention. For example, glucose, dextrose monohydrate and beet molasses have proven satisfactory. The carbon may also be derived from the acid employed to adjust the pH of the work mixture, for example, from lactic acid. With the Candida yeasts glucose, sucrose, maltose, cellobiose, ethanol, glycerin or citrate are all suitable carbon sources. With *Enterobacter aerogenes*, lactose may additionally be employed.

Generally, 16.5 assimilative carbons are required as an absolute minimum for assimilation of a molecule of nitrate. On the other hand, the amount of carbon source is preferably kept as close as possible to the threshold, since any excess will remain in the final denitrated extract. The threshold is generally about 20±5 carbons/nitrate molecule. With good aeration, a maximum of about 6.2 g/l $NO_3$ can be assimilated with a 4% glucose solution. In general, with nitrate levels of 3–7.5 g/l added to the work mixture, a concentration of 2.4–6% glucose is required when employing Candida yeasts.

In the practice of the invention, temperature affects the amount of carbon required. At temperatures of about 28°–30° C., minimal amounts, i.e., about 16.5 carbons, may be used. Outside this temperature range, the amount of carbon must be increased. Further temperature and growth rate of the microorganisms are directly related. Thus higher temperatures favor increased growth of microorganisms. However, increases in temperature also increase the fermentation rate, with resultant alcohol formation rather than growth. The rate of fermentation may be checked by measuring ethanol formation during the process. Temperatures which minimize fermentation while maximizing growth are thus preferred. In the case of *Candida utilis*, 30° C. is the preferred temperature.

To regulate and maintain pH, acids and/or bases are employed in the work mixture. Ortho-phosphoric acid and/or potassium hydroxide are preferred for this purpose. The agent employed to adjust pH may also be the phosphate or carbon source, for example, phosphoric, lactic or citric acid or mixtures thereof Thus, where phosphoric acid is employed to regulate pH, no other addition of phosphate in the additive mixture is required.

Aeration of the work mixture is generally at a rate which is sufficient to avoid fermentation while favoring assimilation. Generally a rate of 0.8 liters air per liter work mixture per minute is the threshold aeration rate required to avoid fermentation where maximum carbon levels are employed. Overall, aeration rates of between 0.5 and 2.5 are suitable in the practice of the process, with rates of 1.0 to 2.0 being particularly effective.

In order to overcome the effects of air injection, it may be necessary to employ a mechanical foam breaker or antifoam agent. Paracum 05/12A and 24/sw have both been found satisfactory. Addition of 225 ppm to the work mixture is adequate but levels of 250 ppm are preferred to ensure trouble-free operation.

The precise conditions employed in the practice of the present invention will depend upon the precise organism employed. In general, when two of the three conditions for aerobic assimilation are optimized, the third variable can be changed empirically. Further, it should be noted that since the nitrate extracts being treated are solutions of naturally occurring products whose components vary, optimum conditions are not always the same, but will vary within the ranges indicated. For example, in the case of *Candida utilis* NCYC 707, optimum conditions for the practice of the invention in the treatment of some extracts are an aeration rate of 1.5 l/l/min., a temperature of 30° C. and a pH of 5.5. Thus, very good results are obtained with an aeration of 1.5 liters/liters/minute, a pH value of 5.5 and a temperature between 26° and 37° C.; with an aeration of 1.5 liters/liters/ minute, a temperature of 30° C. and a pH between 3.9 and 5.5; or with a temperature of 30° C., a pH of 5.5 and aeration between 0.5–1.0 liters/liters/minute.

A denitration system employing the process of the invention is depicted in the flow diagram of FIG. 1. The reference numbers refer to the denitration stages as follows:

1. Tobacco supply
2. Water tank
3. Supply for additives
4. Washer with partition
5. Mixer
6. Sterilization section
7. Sterilization section
8. Mixer
9. Dosage pump
10. Work container (possibly fermentor)
12. Pasteurization
13. Centrifuge
14. Treatment section
15. Device for readding of materials
17. pH regulator
18. Temperature regulator
19. Aerator 20. Stirrer
21. Device for adding antifoaming agent
22. Section for reconstitution
23. Drier The material to be treated, for example, tobacco stems, is added from tobacco supply 1 and mixed with water from water tank 2 in washer 4. The soluble components are separated from the insoluble tobacco residue. The insoluble residue is passed to drier 23 or reconstitution stage 22. The extracted soluble components are conveyed to 6 where sterilization by heating and thereafter cooling takes place. Specifically, the treatment in sterilization sections 6 and 7 may consist of preheating to 100° C., sterilization of 110° C. for over 40 minutes and cooling to 30° C.

The necessary additives, mostly phosphate and glucose, travel from supply 3 with water to mixer 5 and as solution to section 7, where they are sterilized by heating and thereafter cooled. The solutions from the two treatment sections 6 and 7 are mixed in mixer 8 and are by way of dosage pump 9 transferred into work vessel 10. To start, fermentor 10 may contain a work mixture, comprising the product solution with the necessary additives and an inoculum of the desired microorganism, from which all the nitrates, nitrites and ammonium compounds will generally be eliminated after about 8–20 hours, whereupon the continuing process can be started by the dosage pump 9 at the rate desired for dilution and regulated in such a way as to keep the volume of the work mixture in fermentor 10 constant. According to the products and microorganisms used, the working conditions are regulated in such a way as to totally eliminate nitrates, nitrites and ammonium compounds contained in the product solution and to completely use all additives from mixer 5 during this assimilation. The treated work mixture in fermentor 10 is removed. The biomass is removed from the treated work mixture in centrifuge 13 and may be saved for further usage. If necessary, the treated work mixture may be pasteurized in section 12 as shown in FIG. 1 or pasteurization of the liquid portion resulting from biomass removal in section 13 may be effected. The remaining treated liquid is conveyed to treatment section 14 as final solution for concentration, as by evaporation. This final solution, containing most of the components of the product solution, except the nitrates, nitrites and ammonium compounds may now be used in any way. The solution may for example, be sprayed onto the dried or reconstituted tobacco residue with device 15 for readding materials. The reconstituted product resembles tobacco sheets.

In a preferred mode the present invention comprises extracting tobacco with water employing a 10:1 water to tobacco ratio at 90° C. for 60 minutes. The extract thus formed is separated from the insoluble tobacco residue. If necessary, the nitrate concentration in the extract is adjusted to the desired level by conventional means such as dilution or evaporation. The extract at a dilution of 3 to 7.5 g $NO_3$/liters, preferably 4.5–5.5 g/l and most preferably 5 g/l, is thereupon combined with sufficient $K_2HPO_4$ to give a phosphate concentration of 1.1–1.5, preferably 1.25, and glucose is added to a concentration of 4%, along with 250 ppm antifoam, such as Paracum 24/sw. The pH is adjusted to 5.5 employing KOH. The mixture may then be sterilized at 110° C. for forty minutes. Alternatively, the extract and additives may be separately sterilized prior to mixing.

The sterilized extract solution containing the additives is thereupon introduced into a fermentation vessel containing a work mixture at a rate of 0.18–0.22 l/l/hr, preferably 0.2 l/l/hr. The work mixture contains a suitable microorganism and is preferably a starter culture of *Candida utilis* NCYC 707 yeast in exponential, most preferably late exponential, growth phase which has been built up as above described. The pH of the work mixture is maintained at about 5.5±0.3 preferably by addition of a mixture of 9 parts lactic acid to 1 part o-phosphoric acid and/or KOH. The temperature of the mixture is maintained at 30±3° C. The vessel containing the work mixture is aerated at a rate of 1.4–1.6 and preferably 1.5 l/l/min. and the mixture is agitated. In smaller vessels it may be desirable to shut off the air for one minute every two hours, whereby the pressure is reduced and the condenser on the outgoing air is purged. This can be accomplished by means of an electromagnetic valve coupled with a time on the incoming air. Such purging avoids wetting of the sterile filter. Such purging is generally unnecessary when working in larger fermentors, as for example, when a 500 l working volume is employed in a 750 l fermentor.

Simultaneously with and at a rate equal to the introduction of the sterilized solution, a portion of the work mixture, i.e., treated extract is withdrawn from the fermentation vessel so that the volume of work mixture remains constant. The treated extract is thereupon pasteurized, separated from the biomass and concentrated. The thus denitrated, concentrated extract may then be applied to the dried and/or reconstituted insoluble tobacco residue. Employing the above procedure, the process of the invention has been practiced continuously for five weeks with production of 2400 liters denitrated extract per day which is equal to one-fifth of the volume of the fermentor employed per hour, i.e., 100 liters fermented denitrated extract per hour.

Where *Enterobacter aerogenes* ATCC 13048, or other bacterium, is employed the conditions of the work mixture are adjusted to a pH of 5.5–8.0, preferably 7.0, and a temperature of 30°–40° C., preferably 37° C., and the process is operated at an aeration rate of 1.0–3, preferably 2 l/l/min., a dilution rate of 0.1–0.25, preferably 0.2 l/l/hr., with the addition mixture containing 0.1–7.5 g nitrate/l, preferably 5 g/l.

The invention is preferably used in treatment of tobacco extracts, but is not limited to that usage. Elimination of nitrates, nitrites and ammonium compounds from foods and other consumer items may also be desirable. Where these materials are in liquid form, they may be used as the nitrate solution for treatment in the practice of the invention. Otherwise an aqueous solution can be obtained by washing, which solution, following denitration, may be recombined with the insoluble fraction of the material to form the final denitrated product.

In the case of tobacco, the work conditions can be gauged by the nitrate concentration of the product solution. To determine working conditions for foods and other consumer items, the concentration of the sum of all compounds to be eliminated, i.e., nitrates and nitrites and ammonium compounds should be considered. This total concentration of these materials in the overall additive mixture should be between 3 and 7.5 g/liter. The remaining parameters may be the same as in treatment of tobacco. Thus, although the invention has been described in terms of its application to tobacco, it may—apart from the limitations described before—just as well be applied in the treatment of foods and other consumer goods.

The following examples are illustrative of the invention.

EXAMPLES 1-10

Tobacco stems were extracted with water and the resultant extracts were treated with *Candida utilis* NCYC 707 according to the process of the invention using the conditions specified in Table IV. The results are set forth in Table IV. "0" indicates an amount, which is not detectable using normal analysis conditions; it is smaller than 10 ppm in the case of carbon and phosphate and is less than 1 ppm for nitrates, nitrites and ammonium compounds.

TABLE IV

| | EXAMPLES | | | | | | | | | |
|---|---|---|---|---|---|---|---|---|---|---|
| | 1 | 2 | 3 | 4 | 5 | 6 | 7 | 8 | 9 | 10 |
| Starting Solution: Concentration in g/liter | | | | | | | | | | |
| Nitrate | 5.0 | 5.0 | 5.0 | 5.0 | 5.0 | 4.1 | 4.9 | 7.5 | 3.0 | 1.0 |
| Nitrite | 0 | 0 | 0 | 0 | 0 | 0 | 0 | 0 | 0 | 0 |
| Ammonium Compounds | 0.08 | 0.08 | 0.08 | 0.08 | 0.08 | 0.1 | 0.1 | 0.1 | 0.1 | 0.1 |
| Phosphate | 1.25 | 1.25 | 10.00 | 1.25 | 1.25 | 1.25 | 1.25 | 1.6 | 0.75 | 0.25 |
| Glucose | 40 | 40 | 40 | 40 | 40 | 40 | 40 | 60 | 24 | 8 |
| Fermentation Conditions | | | | | | | | | | |
| Temperature | 30 | 30 | 30 | 30 | 30 | 37 | 26 | 30 | 30 | 30 |
| pH level | 5.5 | 3.9 | 5.5 | 5.5 | 5.5 | 5.5 | 5.5 | 5.5 | 5.5 | 5.5 |
| Aeration Rate 1/1/minute | 1.5 | 1.5 | 1.5 | 1.5 | 1.5 | 1.5 | 1.5 | 2.0 | 1.0 | 0.5 |
| Dilution Rate 1/1/hour | 0.2 | 0.2 | 0.2 | 0.01 | 0.34 | 0.2 | 0.2 | 0.2 | 0.2 | 0.2 |
| Denitrated Extract-Final Concentration | | | | | | | | | | |
| Nitrate | 0 | 0 | 0 | 0 | 0 | 0 | 0 | 0 | 0 | 0 |
| Nitrite | 0 | 0 | 0 | 0 | 0 | 0 | 0 | 0 | 0 | 0 |
| Ammonium Compounds | 0 | 0 | 0 | 0 | 0 | 0 | 0 | 0 | 0 | 0 |
| Phosphate | 0.1 | 0.1 | 8.4 | 0.1 | 0.1 | 0.1 | 0.1 | 0 | 0 | 0 |
| Glucose | 0 | 0 | 0 | 0 | 0 | 0 | 0 | 0 | 0 | 0 |

EXAMPLE 11

Seven tobacco extracts were prepared by separately washing tobacco stems and by-products with water at a 1:10 tobacco to water ratio and combining a stem extract with a by-product extract. With appropriate installations, it would be possible to effect the extraction, as well as the denitration, on a continuous basis. The nitrate levels of each tobacco extract are set forth in Table V. To each tobacco extract were added glucose, $KH_2PO_4$ and Paracum 24/sw antifoam as indicated in Table V. The ph was adjusted to 5.5 with KOH. The extract and additives were sterilized at 110° C. for 40 min.

The work mixture comprised *Candida utilis* 707, lactic acid, KOH and Paracum-24/sw and had a pH of 5.5. The 14 l fermentor, which was employed, was equipped with an electromagnetic valve on the incoming air coupled with a timer. The incoming air was shut off for 1 min. every two hours to thus purge the condenser on the outgoing air.

About 1700 l of extract were denitrated on a continuous basis except for the first two weekends when the system was cooled down with agitation reduced to 300 rpm and air flow reduced to 30%. After the first week there was no supervision over the weekends or during the nights. Except for a problem with the weight control system, which resulted in the fermentor's being empty one morning, the operation ran smoothly.

During denitration 200 ml of lactic acid were consumed per 3 kg of extract. This is probably explained by the fact that the acid was being used by the microorganisms as a carbon source.

The biomass was removed from the denitrated extract by centrifugation. The resulting 1478 g of extract containing 3% tobacco solubles was thereupon concentrated to give an average concentration of 39.06 tobacco solubles and reapplied to dried tobacco stems.

The average values of the composition of several samples were measured after extraction, after sterilization of the combined extract and additives and following concentration of the denitrated extract. These values are set forth in Table VI.

TABLE V

| | $NO_3$—N | $NO_3^-$ | Glucose | $KH_2PO_4$ | Anti-foam (Paracum 24/SW) |
|---|---|---|---|---|---|
| Extract | 0.54 g/l | 2.41 g/l | 4% | 0.5% | 250 ppm |
| Extract | 0.57 | 2.52 | 3% | 0.5% | 225 ppm |
| Extract | 0.57 | 2.53 | 3% | 0.5% | 225 ppm |
| Extract | 0.46 | 2.02 | 4% | 0.5% | 225 ppm |
| Extract | 0.45 | 2.01 | 3% | 0.5% | 250 ppm |
| Extract | 0.48 | 2.12 | 3% | 0.5% | 250 ppm |
| Extract | 0.50 | 2.21 | 3% | 0.5% | 250 ppm |

TABLE VI

| | Extract | Extract and Additives | Concentrated Denitrated Extract |
|---|---|---|---|
| $PO_4^{3-}$ g/l | 0.4 | 2.7 | 24 |
| $SO_4^{2-}$ g/l | 1.32 | 21 | 23 |
| $K^+$ g/l | 6.8 | 10.75 | 70 |
| $Ca^{2+}$ mg/l | 688 | 174 | 1000 |
| $Mg^{2+}$ mg/l | 269 | 230 | 2900 |
| ethanol mg/l | 2.8 | 2.8 | 5.4 |
| methanol mg/l | 13.5 | 20 | 18 |
| acetone mg/l | | 2 | 6.4 |
| acetoine mg/l | | | 183 |
| total C °/oo | 14.4 | 28.1 | 140 |
| $NO_3^-$ g/l | 2.30 | 2.44 | 0.4 |
| $NO_3$—N g/l | 0.52 | 0.55 | 0.09 |
| RS g/l | 4.24 | 41.8 | 5.7 |
| $NH_3$—N g/l | 0.23 | 0.24 | 0 |
| TA g/l | 0.52 | 0.52 | 6.2 |

EXAMPLE 12

A continuous one week pilot plant trial was carried out in a 750 l fermentor (working volume 500 l) with tobacco stem extract. Operating conditions are given in Table VII.

The stems were continuously washed in a screw extractor at a stem to water ratio of 1:10. The extraction was carried out at 90° C. and the tobacco extract (out of the extractor) to water (into the extractor) ratio was 0.74. The tobacco extract was then sterilized by pumping it through 3 heat exchanges: the first to pre-heat it to 110° C., the second to hold it at that temperature for 40 minutes and the third to cool it down to room temperature. Analytical values are given in Table VIII.

A dextrose solution was prepared batchwise, but then continuously pumped through a second line of 3 heat exchangers for sterilization using the above conditions. The two flows, i.e., sugar solution and tobacco extract, were then regulated to the desired sugar concentration in the tobacco extract and then pumped into the fermentor. Nitrate and sugar values are given in Table VIII.

Before the start of continuous operation, the fermentor was filled with 480 kg of tobacco extract, 20.2 kg of dextrose, 2.4 kg of $KH_2PO_4$ and 120 ml of an antifoaming agent, and then sterilized at 120° C. for 40 minutes. After the fermentor had been cooled down, it was inoculated with 13 l of a starter culture of *Candida utilis* 707 grown in tobacco extract. After 12 hours there was no more sugar or nitrate in the batch and the yeasts were in the exponential phase. At this point continuous operation was started. The operating conditions are given in Table VII. The pH regulation was done with phosphoric acid at 25%. The fermentor was equipped with a mechanical foam separator, a turbine aeration/agitation system, and a weight control system.

The continuous stream of fermented extract leaving the fermentor was centrifuged to remove the biomass and then pasteurized before being concentrated.

All these operations except for preparation of the sugar solution were carried out continuously.

TABLE VII

| | Amount | Operating Conditions Total | Time hr. | Temp. °C. | Air 1/1/min. | pH | rpm |
|---|---|---|---|---|---|---|---|
| Extraction | | | 91.5 | | | | |
| stems in | 5–14 kg/hr. | 550 kg | | | | | |
| dry stems out | | 206 kg | | | | | |
| Additives | | | | | | | |
| dextrose (91%) | 3.55% | 199 kg | | | | | |
| Fermentation | | 5600 l | | 30 | 1.5 | 5.0 | 640 |
| inoculum | 2.6% | 13 l | $t_d$ = 1 hr. 57 min. | | | | |
| batch | | 500 kg | 12 | | | | |
| D = 0.11 | 56 l/hr. | 5096 kg | 91 | | | | |
| acid (25%) | 4.29% | 240 kg | | | | | |
| base (25%) | | 23 kg | | | | | |
| Biomass separation | | | | | | | |
| biomass | 5.79% | | | | | | |
| sep. extract | 94.21% | | | | | | |

TABLE VIII

| Analysis | | Analytical results - extract composition: Extract | Extract + additives | Fermented extract | Conc. extract without biomass | biomass |
|---|---|---|---|---|---|---|
| $NO_3$—N | g/l | 1.15 | 1.10 | 0 | 0.06 | 0.8 |
| $NO_2$—N | g/l | 0 | 0 | 0 | 0 | 0 |
| RS | g/l | 6.8 | 38.0 | 1.75 | 10.7 | 3.41 |
| $NH_3$—N | g/l | 0.28 | 0.21 | 0.03 | 0.1 | 0.06 |
| TA | g/l | 0.15 | 0.18 | 0.16 | 1.61 | 0.08 |
| $Ca^{2+}$ | g/l | 0.79 | 0.46 | 0.31 | 1.7 | 0.14 |
| $PO_4^{3-}$ | g/l | 0.57 | 0.30 | 12.90 | 93.5 | 6.9 |

TABLE VIII-continued

| Analysis | | Analytical results - extract composition: Extract | Extract + additives | Fermented extract | Conc. extract without biomass | biomass |
|---|---|---|---|---|---|---|
| $SO_4^{2-}$ | g/l | 0.91 | 0.83 | 5.51 | 29.0 | 5.08 |
| $K^+$ | g/l | 7.63 | | 7.27 | | |
| $Mg^{2+}$ | g/l | 0.37 | | 0.21 | | 0.28 |
| MeOH | g/l | | | 0.03 | | |
| EtOH | g/l | | | 0.36 | | |
| TS | % | 4.6 | 5.2 | 4.78 | 35 | 17.8 |
| density | g/cm$^3$ | 1.02 | 1.02 | 1.02 | | |
| nicotine | ppm | | | | | 505 |
| $N_{tot}$ | g/l | | | | | 9.74 |

What is claimed is:

1. A continuous method for denitrating an aqueous tobacco extract which comprises adding extract to a work mixture containing tobacco extract and microorganisms, said microorganisms being characterized by an aerobic, assimilatory, metabolic pathway for denitrification of tobacco materials and being in exponential growth phase in the work mixture, while maintaining pH, temperature and aeration at levels which promote aerobic assimilation, at a dilution rate which does not exceed the growth rate of the microorganisms while additionally adding phosphate and a carbon source to the work mixture, said extract, phosphate and carbon source being sterile when added and being added in amounts such that the overall addition thereof is 0.1–7.5 g nitrate/l added, 1.0 to 10 g $PO_4$/l added and sufficient carbon source to provide at least 16.5 assimilative carbon atoms/$NO_3$ molecule added, while withdrawing a portion of the work mixture at a rate such that the volume of work mixture remains constant.

2. The method of claim 1 which further comprises removing the microorganisms from the withdrawn mixture.

3. The method of claim 1 wherein the microorganism is a Candida yeast selected from the group consisting of *Candida utilis* NCYC 707, 321 and 359 and *Candida berthetii* CBS 5452.

4. The method of claim 3 wherein the microorganism is *Candida utilis.*

5. The method of claim 3 wherein the microorganism is *Candida utilis* NCYC 707.

6. The method of claim 3 wherein the pH is maintained between 3.5 and 7.2.

7. The method of claim 3 wherein the temperature is maintained between 25° and 37° C.

8. The method of claim 3 wherein the dilution rate is between 0.1 and 0.35 l/l/hr.

9. The method of claim 3 wherein the aeration rate is between about 0.5 and 2.5 l/l/min.

10. The method of claim 3 wherein the aeration rate is 1.0–2.0 l/l/min.

11. The method of claim 3 wherein the overall nitrate addition is 3–7.5 g nitrate/l added.

12. The method of claim 11 wherein the carbon source is glucose added at a concentration of 2.4–6%.

13. The method of claim 3 wherein the overall nitrate addition is 4.5 to 5.5 g/liter added.

14. The method of claim 13 wherein the overall nitrate addition is 5.0 g/liter added.

15. The method of claim 1 wherein the carbon source is selected from the group consisting of glucose, dextrose, sucrose, maltose, cellobiose, lactose, ethanol, glycerin and citrate.

16. The method of claim 1 wherein the carbon source is glucose added at a concentration of 4%.

17. The method of claim 1 wherein the overall phosphate addition is 1.1–1.5 g/liter added.

18. The method of claim 17 wherein the overall phosphate addition is 1.25 g/liter added.

19. The method of claim 1 wherein antifoam is added to the work mixture.

20. The method of claim 19 wherein the antifoam level in the work mixture is at least 250 ppm.

21. The method of claim 1 wherein the microorganism is *Enterobacter aerogenes.*

22. The method of claim 21 wherein the microorganism is *Enterobacter aerogenes* ATCC 13048.

23. The method of claim 21 wherein the pH is maintained between 5.5–8.0.

24. The method of claim 21 wherein the pH is maintained at 7.0.

25. The method of claim 21 wherein the temperature is maintained between 30° and 40° C.

26. The method of claim 21 wherein the temperature is maintained at 37° C.

27. The method of claim 21 wherein the dilution rate is between 0.1 and 0.25 l/l/hr.

28. The method of claim 27 wherein the dilution rate is 0.2 l/l/hr.

29. The method of claim 21 wherein the overall nitrate addition is 5.0 g/l.

30. The method of claim 21 wherein the aeration rate is between 1.0 and 3.0 l/l/min.

31. The method of claim 30 wherein the aeration rate is 2 l/l/min.

32. A method of denitrating an aqueous tobacco extract which comprises treating the extract with a Candida yeast capable of metabolic, aerobic assimilation in a fermentor containing a work mixture comprising tobacco extract and the yeast in exponential growth phase, while agitating and maintaining a pH of 3.9 to 5.5, a temperature of 26° to 37° C. and an aeration rate of 0.5 to 2.0 liters air/liter work mixture/minute in the work mixture, said treatment being effected by (a) introducing a sterilized additive mixture including the extract into the fermentor at a dilution rate of 0.1 to 0.35 liter of additive mixture/liter work mixture/hour, said additve mixture containing 3 to 7.5 grams nitrate/liter of additive mixture, 1.0 to 10 grams phosphate/liter of additive mixture and a carbon source in an amount sufficient to provide at least 16.5 assimilative carbon atoms per nitrate molecule; and (b) withdrawing from the fermentor a portion of the treated extract at a rate such that the volume of the work mixture is kept constant.

33. The method of claim 32 which further comprises removing the biomass from the treated, withdrawn extract.

34. The method of claim 32 wherein the Candida yeast is *Candida utilis.*

35. The method of claim 34 wherein the Candida yeast is *Candida utilis* NCYC 707.

36. The method of claim 32 wherein the pH is maintained at 5.5±0.3.

37. The method of claim 32 wherein the temperature is maintained at 30°±3° C.

38. The method of claim 32 wherein the aeration rate is maintained between 1.4–1.6 l/l/min.

39. The method of claim 38 wherein the aeration rate is maintained at 1.5 l/l/min.

40. The method of claim 32 wherein the aeration rate is at least 0.8 l/l/min.

41. The method of claim 32 wherein an antifoam is employed in the work mixture.

42. The method of claim 41 wherein at least 250 pm Paracum is employed as the antifoam.

43. The method of claim 32 wherein glucose is the carbon source.

44. The method of claim 32 wherein the dilution rate is 0.18–0.22 l/l/hr.

45. The method of claim 44 wherein the dilution rate is 0.2 l/l/hr.

* * * * *